US008795015B1

(12) United States Patent
Nguyen

(10) Patent No.: US 8,795,015 B1
(45) Date of Patent: Aug. 5, 2014

(54) SUBMERGIBLE SUPPORT AND SEATING APPARATUS

(71) Applicant: Hung Van Nguyen, Chelsea, MA (US)

(72) Inventor: Hung Van Nguyen, Chelsea, MA (US)

( * ) Notice: Subject to any disclaimer, the term of this patent is extended or adjusted under 35 U.S.C. 154(b) by 0 days.

(21) Appl. No.: 13/737,354

(22) Filed: Jan. 9, 2013

Related U.S. Application Data

(60) Provisional application No. 61/666,334, filed on Jun. 29, 2012.

(51) Int. Cl.
*B63B 35/74* (2006.01)

(52) U.S. Cl.
USPC ..... 441/129; 441/130

(58) Field of Classification Search
USPC ..... 441/129, 130
See application file for complete search history.

(56) References Cited

U.S. PATENT DOCUMENTS

| | | | | |
|---|---|---|---|---|
| 4,662,852 | A * | 5/1987 | Schneider et al. | 441/132 |
| 5,088,723 | A | 2/1992 | Simmons | |
| 5,403,220 | A | 4/1995 | Goad, Sr. | |
| 6,000,353 | A | 12/1999 | De Leu | |
| D554,224 | S | 10/2007 | Peterson | |
| 7,841,914 | B1 | 11/2010 | Gonzalez | |
| 2010/0248568 | A1 | 9/2010 | Brindle | |

* cited by examiner

*Primary Examiner* — Edwin Swinehart

(57) ABSTRACT

A support and seating apparatus, comprising land based and aquatic capabilities, is presented to support human beings, animals and accompanying objects. The apparatus comprises two back support bars, two torso support bars, two leg support bars and two arm support bars. Pluralities of floatable cylinders are disposed between the bars to enable the support and seating apparatus capable of seating on land and floating on water. The apparatus further comprise a removable shade and a propulsion system for enhanced functionality.

13 Claims, 6 Drawing Sheets

SUBMERGIBLE SUPPORT AND SEATING APPARATUS

CROSS REFERENCE

This application claims 1 priority to U.S. Provisional Application Ser. No. 61/666,334 filed Jun. 29, 2012, the disclosure of which is incorporated herein by reference in its entirety.

FIELD OF THE INVENTION

This invention relates to apparatuses for support of humans, animals and accompanying objects, more particularly, to devices which may be utilized in both land based and aquatic based applications, and apparatuses which are capable of providing a propeller system and an exercise system to a user.

BACKGROUND OF THE INVENTION

Numerous reclining supports systems such as inflatable or floating chairs have been between a pair of parallel elongated floats which are integral with a transverse float supporting the backrest of the chair, and also to extend a leg supporting portion of the chair beyond the forward end of the elongated floats. Such floating chairs have been used to float freely in a pool, or to move with the aid of manual locomotion, such as by hand-held or foot-rotated paddles. Internal combustion and electric powered marine propulsion equipment is well known for various boats, but such equipment appears to be unsuitable for meeting the special requirements of floating chairs. Inflatable devices for recreation and exercise which are adapted to support a person thereon have been devised in a variety of forms. Generally, it is characteristic of the prior art devices that when a person is reclined on such a pad, the side of the person which contacts the pad does not directly contact the water on which the pad is floated and he is therefore precluded from any soothing or therapeutic effects as might be conveyed to him by contact with the water. This is particularly so if the pad is floated in a pool of water, such as a spa, wherein jets of water and air are directed into the water to massage and soothe the person's body. Some of the prior art devices permit a partial submergence of the body, with the legs of the person angled with respect to the torso in a form of sitting position. None of the prior art devices, however, disclose any means for adjusting the buoyancy of the flotation device when in the water, and particularly the relative buoyancies of the different body supporting sections, such as the torso and leg supporting sections, as would allow an adjustment of the relative inclinations of these sections and their levels of submergence by the person when reclined thereon.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a support and seating apparatus with land based and aquatic capabilities to support human beings, animals and accompanying objects. The apparatus comprises two back support bars, two torso support bars, two leg support bars and two arm support bars. Pluralities of floatable cylinders are disposed between the bars to enable the support and seating apparatus capable of seating on land and floating on water. The apparatus further comprise a removable shade and a propulsion system for enhanced functionality.

The support and seating apparatus may include two propellers driven by a foot pedal shaft such that a user can propel while sitting or lying on the apparatus above a water surface. Furthermore, the system may contain a shade apparatus disposed to block unwanted sunlight from the user, particularly the facial area. The system may also contain entertainment panel comprising a cup holder and a water proof speaker for more functionalities.

There has thus been outlined, rather broadly, the more important features of the versatile tray table embodiments in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

DESCRIPTION OF PREFERRED EMBODIMENTS

Figure 1:
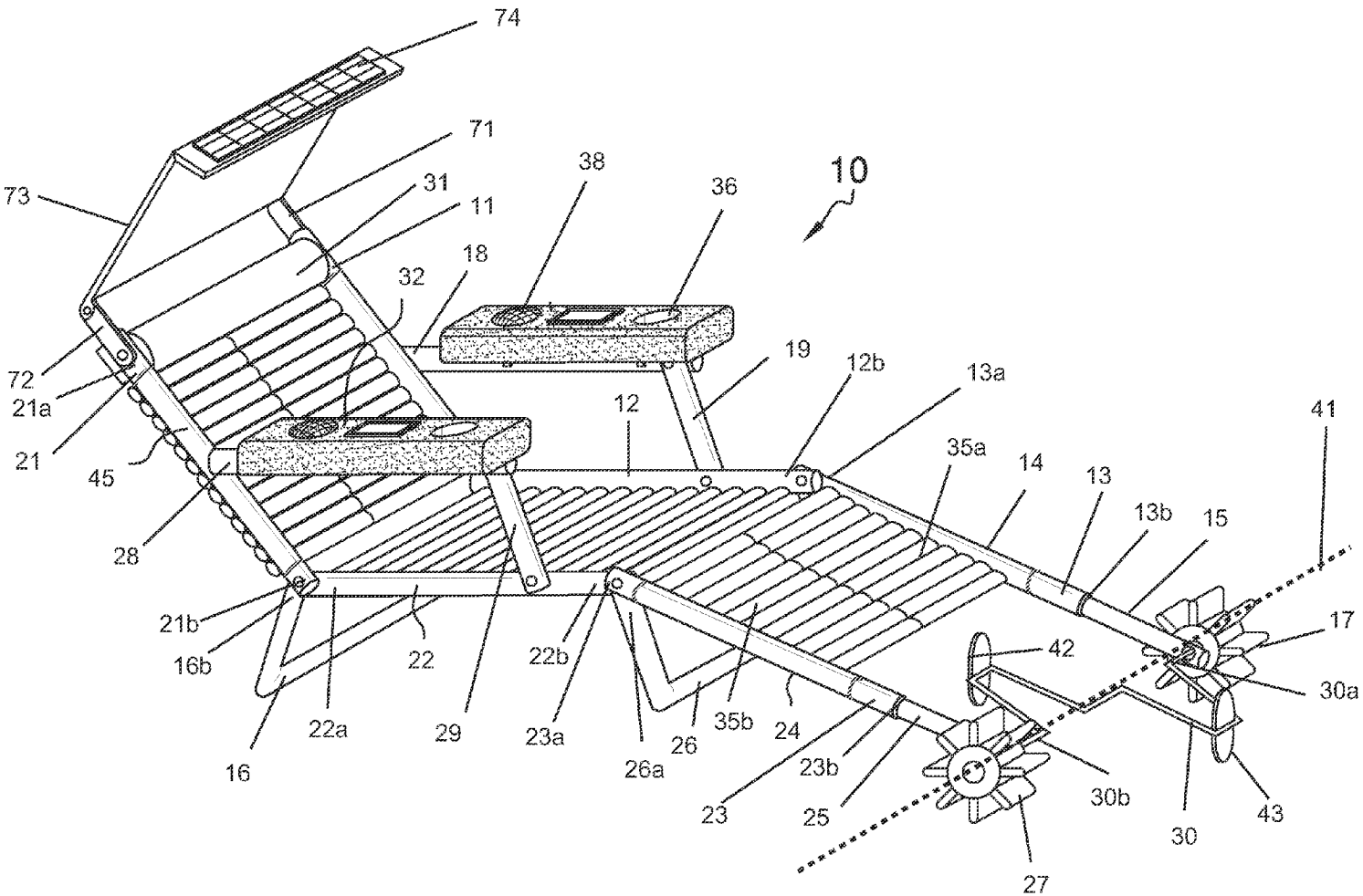
FIG. 1 shows a left isometric view of a support and seating apparatus for land and aquatic applications.
Figure 2:
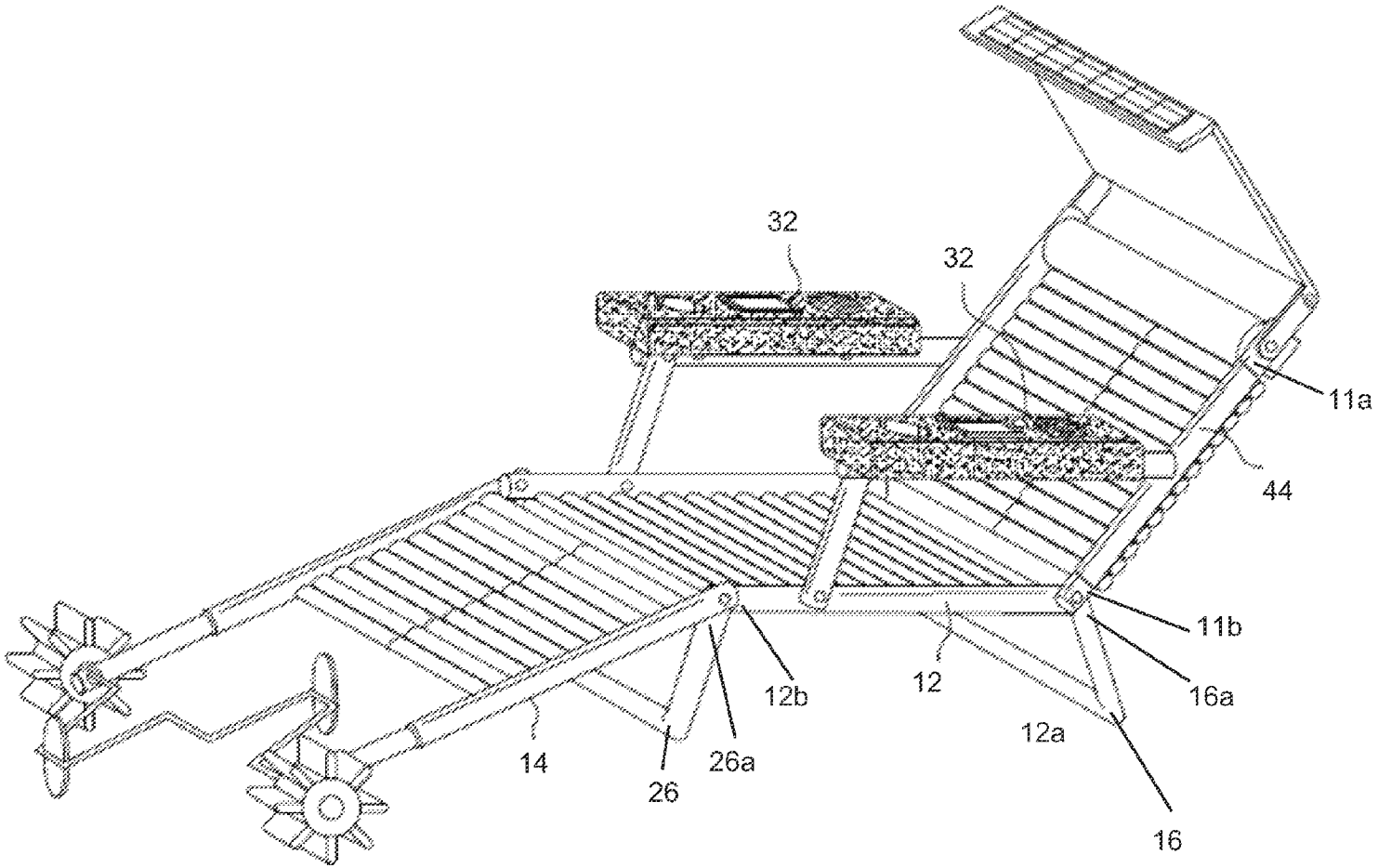
FIG. 2 shows a right isometric view of the support and seating apparatus.
Figure 3:
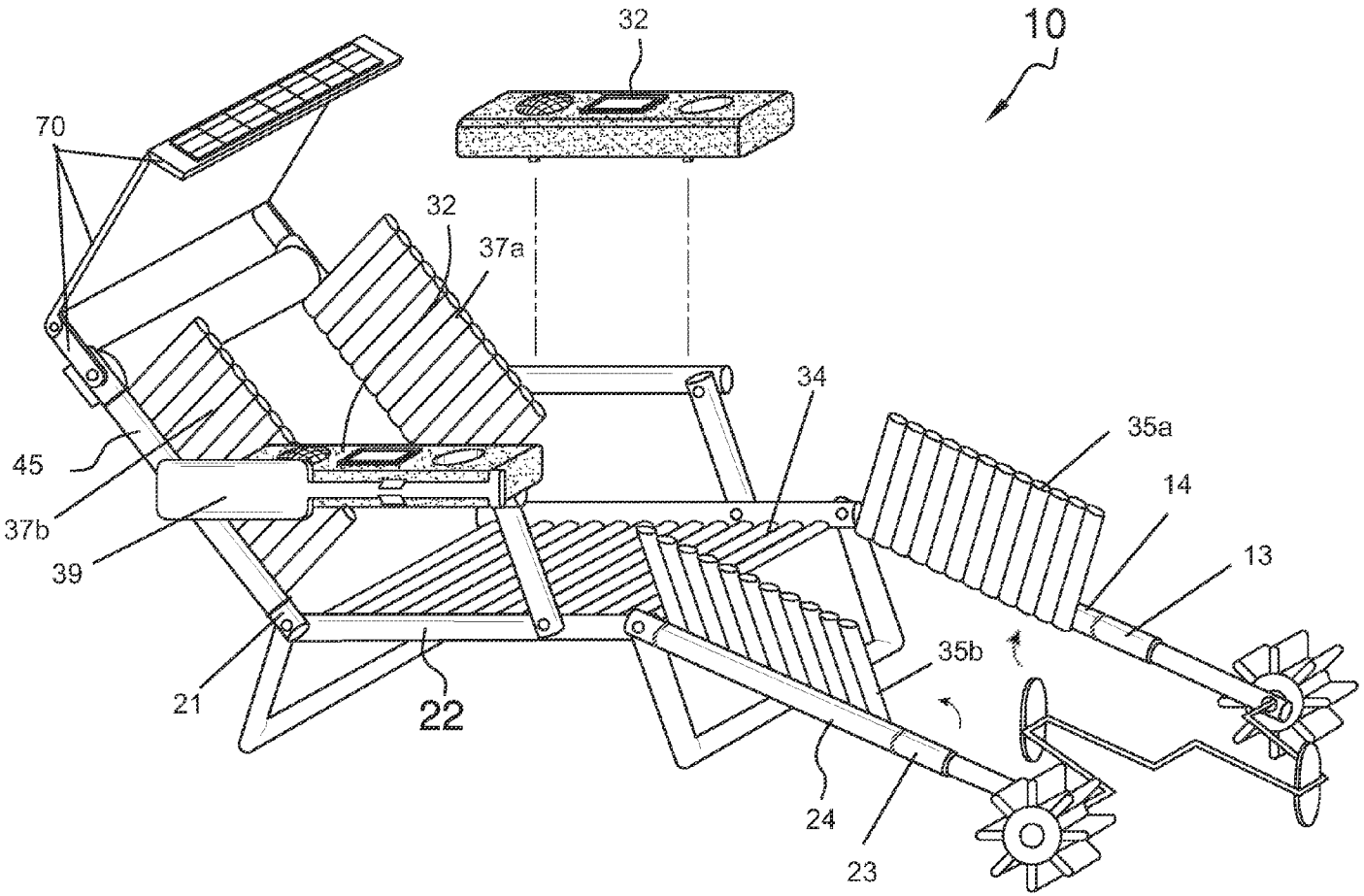
FIG. 3 shows an isometric view of the support and seating apparatus with a leg body support portion opened.
Figure 4:
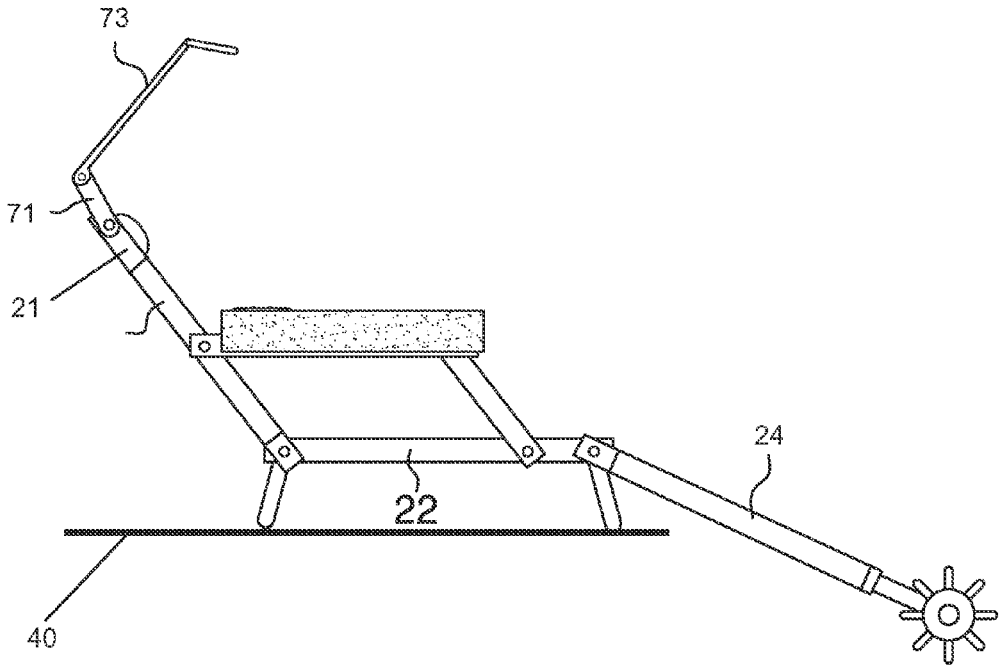
FIG. 4 shows a side view of the support and seating apparatus.
Figure 5:
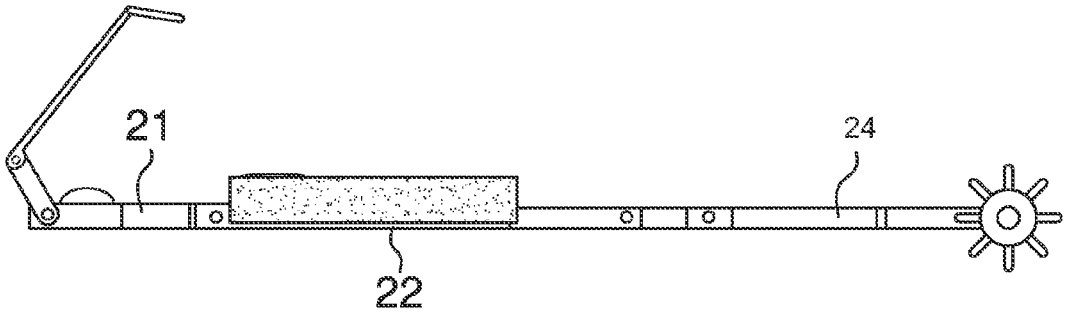
FIG. 5 shows an alternative side view of the support and seating apparatus.
Figure 6:
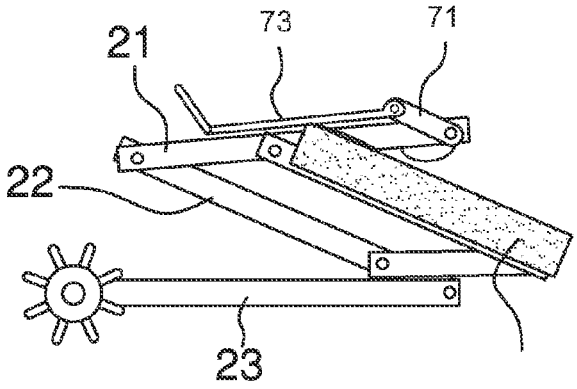
FIG. 6 shows a collapsed view of the support and seating apparatus, wherein the apparatus is collapsed for storage or carriage.
Figure 7:
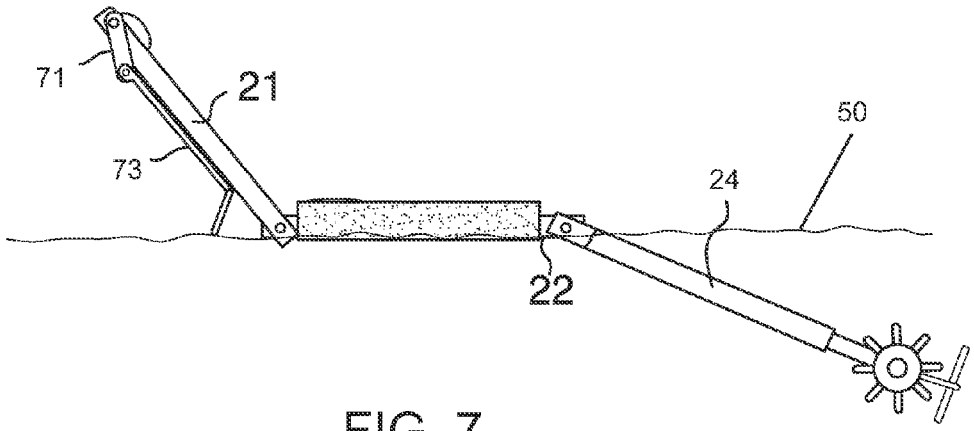
FIG. 7 shows a side view of the support and seating apparatus on a water surface.
Figure 8:
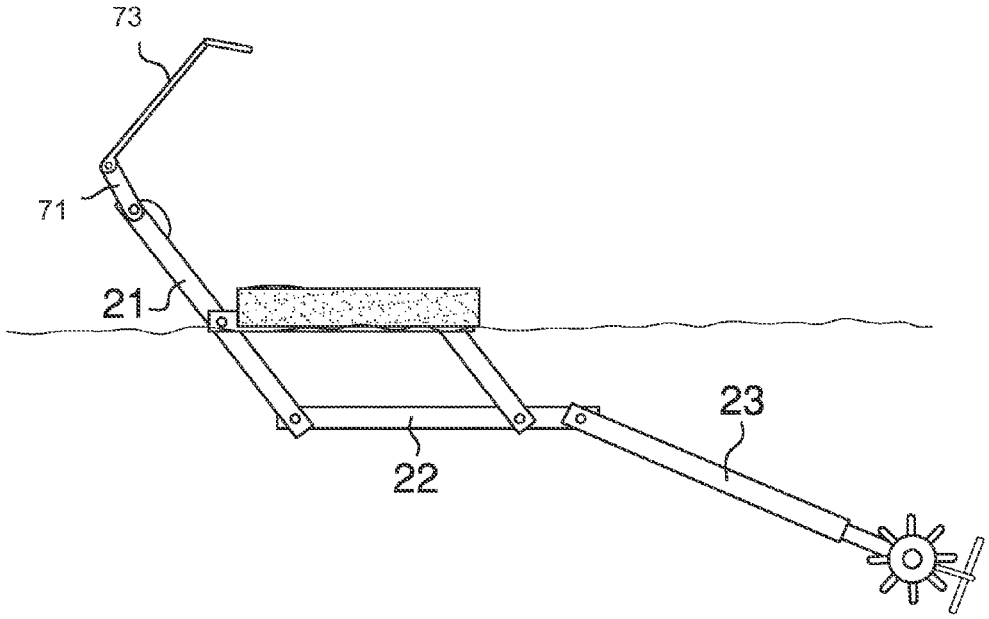
FIG. 8 shows an alternative side view of the support and seating apparatus on a water surface.

Following is a list of elements corresponding to a particular element referred to herein:

10 support and seating apparatus
11 first back support bar
11*a* first end of the first back support bar
11*b* second end of the first back support bar
12 first torso support bar
12*a* first end of the first torso support bar
12*b* second end of the first torso support bar
13 first leg support bar
13*a* first end of the first leg support bar
13*b* second end of the first leg support bar
14 first leg sleeve
15 first telescoping shaft
16 first stand frame
16*a* first end of the first stand frame
16*b* second end of the first stand frame
17 first propeller
18 first arm support bar
19 first connection bar
21 second back support bar 11*a*
21*a* first end of the second back support bar
21*b* second end of the second back support bar
22 second torso support bar
22*a* first end of the second torso support bar
22*b* second end of the second torso support bar
23 second leg support bar
23*a* first end of the second leg support bar
23*b* second end of the second leg support bar
24 second leg sleeve
22 torso support portion
22*a* proximal end of the torso support
22*b* distal end of the torso support 73
23 lower body support portion
24 second telescoping shaft
25 second telescoping shaft
26 second stand frame
26*a* first end of the second stand frame
26*b* second end of the second stand frame
27 second first propeller
28 second arm support bar
29 second connection bar
30 foot pedal shaft
31 hear support roll
32 entertainment panel
34 long floatable cylinders
35*a* floatable cylinders on the first leg sleeve
35*b* floatable cylinders on the second leg sleeve
36 cup holder
37*a* floatable cylinders on the first back sleeve
37*b* floatable cylinders on the second back sleeve
38 water-proof speaker
39 oar
40 land surface
41 propeller rotation axis
42 first foot pedal
43 second foot pedal
44 first back sleeve
45 second back sleeve
50 water surface
70 adjustable shade apparatus
71 first connection bracket
72 second connection bracket
73 cover Referring now to FIG. 1-8, the present invention features a support and seating apparatus (10) for land and aquatic applications, disposed to support human beings, animals and accompanying objects. The support and seating apparatus (10) comprises two first back support bars, two torso support bars, two leg support bars and two arm support bars.

The support and seating apparatus (10) includes a first back support bar (11) with a first end (11*a*) and second end (11*b*), a second back support bar (21) with a first end (21*a*) and second end (21*b*), wherein the first back support bar (11) and the second back support bar (21) are parallel to each other. A first back sleeve (44) rotatably covers the first back support bar (11) and a second back sleeve (45) rotatably covers the second back support bar (21), wherein a plurality of floatable cylinders (37*a*) are attached on the first back sleeve (44) and a plurality of second floatable cylinders (37*b*) are attached second back sleeve (45), wherein the first back sleeve (44) and second back sleeve (45) are rotatable between a closed position and an open position, wherein in the closed position, the floatable cylinders (37*a*) on the first back sleeve and the floatable cylinders (37*b*) on the second back sleeve are straightly aligned, wherein in the open position, the floatable cylinders (37*a*) on the first back sleeve and the floatable cylinders (37*b*) on the second back sleeve are away from straight alignment.

The support and seating apparatus (10) also includes a first torso support bar (12) with a first end (12*a*) and second end (12*b*), a second torso support bar (22) with a first end (22*a*) and second end (22*b*), wherein the first torso support bar (12) and the second torso support bar (22) are parallel to each other and are connected by a plurality of long floatable cylinders (34) along the torso support bars; wherein the first end (12*a*) of the first torso support bar (12) is pivotably connected to the second end (11*b*) of the first back support bar (11), wherein the first end (22*a*) of the second torso support bar (22) is pivotably connected to the second end (21*b*) of the second back support bar (21).

The support and seating apparatus (10) also includes a first arm support bar (18) and a second arm support bar (28), wherein the first arm support bar (18) is pivotably attached to the first back support bar (11) between the first end (11*a*) and the second end (11*b*), wherein the second arm support bar (28) is pivotably attached to the second back support bar (21) between the first end (21*a*) and the second end (21*b*).

The support and seating apparatus (10) also includes a first connection bar (19) and a second connection bar (29), wherein the first connection bar (19) has a first end (19*a*) and a second end (19*b*), wherein the first end (19*a*) of the first connection bar (19) is pivotably connected to the first arm support bar (18), wherein the second end (19*b*) of the first connection bar (19) is pivotably attached to the first torso support bar (12) between the first end (12*a*) and the second end (12*b*) of the first torso support bar (12), wherein the second connection bar (29) has a first end (29*a*) and a second end (29*b*), wherein the first end (29*a*) of the second connection bar (29) is pivotably connected to the second arm support bar (28), wherein the second end (29*b*) of the second connection bar (29) is pivotably attached to the second torso support bar (22) between the first end (22*a*) and the second end (22*b*) of the second torso support bar (22).

The support and seating apparatus (10) also includes a first leg support bar (13) with a first end (13*a*) and second end (13*b*), a second leg support bar (23) with a first end (23*a*) and second end (23*b*), wherein the first leg support bar (13) and the second leg support bar (23) are parallel to each other: wherein the first end (13*a*) of the first leg support bar (13) is pivotably connected to the second end (12*b*) of the first torso support bar (12), wherein the second end (23*a*) of the second leg support bar (23) is pivotably connected to the second end (22*b*) of the second torso support bar (22); wherein a first leg sleeve (14) rotatably covers the first leg support bar (13) and a second leg sleeve (24) rotatably covers the second leg support bar (23), wherein a plurality of floatable cylinders (35*a*) on the first leg sleeve are attached on the first leg sleeve (14) and a plurality of floatable cylinders (35*b*) on the second leg sleeve are attached second leg sleeve (24), wherein the first leg sleeve (14) and second leg sleeve (24) are rotatable between a closed position and an open position, wherein in the closed position, the floatable cylinders (35*a*) on the first leg sleeve and the floatable cylinders (35*a*) on the second leg sleeve are straightly aligned, wherein in the open position, the floatable cylinders (35*a*) on the first leg sleeve and the floatable cylinders (35*a*) on the second leg sleeve are away from straight alignment.

The support and seating apparatus (10) also includes a first telescoping shaft (15) and a second telescoping shaft (25), wherein the first telescoping shaft (15) is telescopedly attached to the second end (13*b*) of the first leg support bar (13), wherein the second telescoping shaft (25) is telescopedly attached to the second end (23*b*) of the second leg support bar (23).

The support and seating apparatus (10) also includes a first propeller (17) rotatably attached to a distal end of the first telescoping shaft (15) and a second propeller (27) rotatably attached to a distal end of the second telescoping shaft (25), wherein both the first propeller (17) and the second propeller (27) are rotatably driven by a foot pedal shaft (30) around a common propeller rotation axis (41), wherein the foot pedal shaft (30) has a first shaft end (30*a*) connected to the first propeller (17) and a second shaft end (30*b*) connected to the second propeller (27). In some embodiments, a first foot pedal (42) and a second foot pedal (43) are attached on the foot pedal shaft (30) for manual driven of the first propeller (17) and second propeller (27).

The support and seating apparatus (10) can be used for aquatic applications, the support and seating apparatus (10) is used for aquatic applications, the support and seating apparatus (10) is floatable with the floatable cylinders (34), the floatable cylinders (35*a* and 35*b*) on the first and second leg sleeves, and the floatable cylinders (37*a* and 37*b*) on the first and second back sleeves.

In some embodiments, the support and seating apparatus (10) further comprises a first stand frame (16) and a second stand frame (26), wherein the first stand frame (16) is an U-shaped bracket having a first end (16*a*) pivotably and removably connected to the first end (12*a*) of the first torso support bar (12) and a second end (16*b*) pivotably and removably connected to the first end (22*a*) of the second torso support bar (22), wherein the second stand frame (26) is an U-shaped bracket having a first end (26*a*) pivotably and removably connected to the second end (12*b*) of the first torso support bar (12) and a second end (26*b*) pivotably and removably connected to the second end (22*b*) of the second torso support bar (22). When the support and seating apparatus (10) is used for land applications, the support and seating apparatus (10) is held either with the first stand frame (16) and the second stand frame (26) resting on a land surface (40) or with the first torso support bar (12) and the second torso support bar (22) resting on the land surface (40) directly.

In some embodiments, the support and seating apparatus (10) is foldable to a flat configuration such that the first back support bar (11), the first torso support bar (12), the first leg support bar (13), the second back support bar (21), the second torso support bar (22), the second leg support bar (23), the first arm support bar (18), the second arm support bar (28), the first connection bar (19) and the second connection bar (29) are all on one plane.

In some embodiments, the support and seating apparatus (10) further comprises an entertainment panel (32) disposed on the first arm support bar (18) or the second arm support bar (28), wherein the entertainment panel (32) comprises a waterproof speaker (38), a cup holder (36). In some embodiments, the water-proof speaker (34) is a Bluetooth speaker with internal battery power. In some embodiments, the entertainment panel (32) is floatable.

In some embodiments, the support and seating apparatus (10) further comprises a hear support roll (31) disposed between the first end (11*a*) of the first back support bar (11) and the first end (21*a*) of the second back support bar (21), wherein the hear support roll (31) is floatable.

In some embodiments, the support and seating apparatus (10) further comprises an adjustable shade apparatus (70) having a first connection bracket (71), a second connection bracket (72) and a cover (73), wherein the first connection bracket (71) is removably and pivotably attached to the first end (11*a*) of the first back support bar (11), wherein the second connection bracket (72) is removably and pivotably attached to the first end (21*a*) of the second back support bar (21), wherein the cover (73) is pivotably connected to the first connection bracket (71) and the second connection bracket (72), wherein the shade apparatus (70) is pivotable between a deployed position and a folded position, wherein at the deployed position, the shade apparatus (70) provides a desired shade means to block unwanted sunlight; wherein at the folded position, the shade apparatus (70) retracts to be aligned with the first and second back support bars on a side opposite to the direction of the first and second arm support bars. In some embodiments, the cover (73) is made of light reflective material, such as metallized fabrics or metallized film.

In some embodiments, the support and seating apparatus (10) is foldable to a flat configuration such that the first back support bar (11), the first torso support bar (12), the first leg support bar (13), the second back support bar (21), the second torso support bar (22), the second leg support bar (23), the first arm support bar (18), the second arm support bar (28), the first connection bar (19) and the second connection bar (29) are all on one plane.

In some embodiments, a solar panel (74) is disposed on at least part of the cover (73). Solar panels (organic or inorganic film based) are well known to one of ordinary skill in the art.

In some embodiments, the long floatable cylinders (34) have cross section of a circle, oval, rectangle or square. In some embodiments, the long floatable cylinders (34) are made of light weight material such as foam. In some embodiments, the long floatable cylinders (34) are inflatable hollow cylinders, wherein the long floatable cylinders (34) are replaceable such that any broken cylinder can be replaced.

In some embodiments, the long floatable cylinders (34) are inflatable hollow cylinders with the inflation controlled by an adjustable valve and thus the depth of submersion under a water surface (50) is adjustable.

In some embodiments, the first propeller (17) and second propeller (27) are driven by a built-in motor, which is powered by the solar panel (74).

In some embodiments, the support and seating apparatus (10) further comprises an oar (39) removably attached to the first arm support bar (18) or the second arm support bar (28), wherein the oar (39) is removably attached via a clap means, a hook-and-loop fastener means or a combination thereof. In some embodiments, the oar (39) is made of wood, plastics, carbon fiber, metal or a combination thereof.

The support and seating apparatus (10) provides a means for seating, relaxation and therapeutic exercise for both land based and aquatic applications. The design of the instant systems affords a user the opportunity for complete torso and lower body submersion. The inflatable portions may be disposed to be removable in the case of puncturing or component failure.

The disclosures of the following U.S. Patents are incorporated in their entirety by reference herein: (1) U.S. Pat. No. 5,088,723, (2) U.S. Pat. No. 5,403,320, (3) U.S. Pat. No. 6,000,353, (4) U.S. Pat. No. 7,841,914, (5) U.S. Pat. No. 554,224 and (6) US Patent Application Publication 2010/0248568A1.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A support and seating apparatus (10) disposed for land and aquatic applications comprising:

(a) a first back support bar (11) with a first end (11*a*) and second end (11*b*), a second back support bar (21) with a first end (21*a*) and second end (21*b*), wherein the first back support bar (11) and the second back support bar (21) are parallel to each other, wherein a first back sleeve (44) rotatably covers the first back support bar (11) and a second back sleeve (45) rotatably covers the second back support bar (21), wherein a plurality of floatable cylinders (37*a*) are attached on the first back sleeve (44) and a plurality of second floatable cylinders (37*b*) are attached on the second back sleeve (45), wherein the first back sleeve (44) and second back sleeve (45) are rotatable between a closed position and an open position, wherein in the closed position, the floatable cylinders (37*a*) on the first back sleeve and the floatable cylinders (37*b*) on the second back sleeve are straightly aligned, wherein in the open position, the floatable cylinders (37*a*) on the first back sleeve and the floatable cylinders (37*b*) on the second back sleeve are away from straight alignment;

(b) a first torso support bar (12) with a first end (12*a*) and second end (12*b*), a second torso support bar (22) with a first end (22*a*) and second end (22*b*), wherein the first torso support bar (12) and the second torso support bar (22) are parallel to each other and are connected by a plurality of long floatable cylinders (34) along the torso support bars; wherein the first end (12*a*) of the first torso support bar (12) is pivotably connected to the second end (11*b*) of the first back support bar (11), wherein the first end (22*a*) of the second torso support bar (22) is pivotably connected to the second end (21*b*) of the second back support bar (21);

(c) a first arm support bar (18) and a second arm support bar (28), wherein the first arm support bar (18) is pivotably attached to the first back support bar (11) between the first end (11*a*) and the second end (11*b*), wherein the second arm support bar (28) is pivotably attached to the second back support bar (21) between the first end (21*a*) and the second end (21*b*);

(d) a first connection bar (19) and a second connection bar (29), wherein the first connection bar (19) has a first end (19*a*) and a second end (19*b*), wherein the first end (19*a*) of the first connection bar (19) is pivotably connected to the first arm support bar (18), wherein the second end (19*b*) of the first connection bar (19) is pivotably attached to the first torso support bar (12) between the first end (12*a*) and the second end (12*b*) of the first torso support bar (12), wherein the second connection bar (29) has a first end (29*a*) and a second end (29*b*), wherein the first end (29*a*) of the second connection bar (29) is pivotably connected to the second arm support bar (28), wherein the second end (29*b*) of the second connection bar (29) is pivotably attached to the second torso support bar (22) between the first end (22*a*) and the second end (22*b*) of the second torso support bar (22);

(e) a first leg support bar (13) with a first end (13*a*) and second end (13*b*), a second leg support bar (23) with a first end (23*a*) and second end (23*b*), wherein the first leg support bar (13) and the second leg support bar (23) are parallel to each other; wherein the first end (13*a*) of the first leg support bar (13) is pivotably connected to the second end (12*b*) of the first torso support bar (12), wherein the second end (23*a*) of the second leg support bar (23) is pivotably connected to the second end (22*b*) of the second torso support bar (22); wherein a first leg sleeve (14) rotatably covers the first leg support bar (13) and a second leg sleeve (24) rotatably covers the second leg support bar (23), wherein a plurality of floatable cylinders (35*a*) on the first leg sleeve are attached on the first leg sleeve (14) and a plurality of floatable cylinders (35*b*) on the second leg sleeve are attached to the second leg sleeve (24), wherein the first leg sleeve (14) and the second leg sleeve (24) are rotatable between a closed position and an open position, wherein in the closed position, the floatable cylinders (35*a*) on the first leg sleeve and the floatable cylinders (35*a*) on the second leg sleeve are straightly aligned, wherein in the open position, the floatable cylinders (35*a*) on the first leg sleeve and the floatable cylinders (35*a*) on the second leg sleeve are away from straight alignment;

(f) a first telescoping shaft (15) and a second telescoping shaft (25), wherein the first telescoping shaft (15) is telescopedly attached to the second end (13*b*) of the first leg support bar (13), wherein the second telescoping shaft (25) is telescopedly attached to the second end (23*b*) of the second leg support bar (23);

(g) a first propeller (17) rotatably attached to a distal end of the first telescoping shaft (15) and a second propeller (27) rotatably attached to a distal end of the second telescoping shaft (25), wherein both the first propeller (17) and the second propeller (27) are rotatably driven by a foot pedal shaft (30) around a common propeller rotation axis (41), wherein the foot pedal shaft (30) has a first shaft end (30*a*) connected to the first propeller (17) and a second shaft end (30*b*) connected to the second propeller (27); and wherein the support and seating apparatus (10) is used for aquatic applications, the support and seating apparatus (10) is floatable with the floatable cylinders (34), the floatable cylinders (35*a* and 35*b*) on the first and second leg sleeves, and the floatable cylinders (37*a* and 37*b*) on the first and second back sleeves.

2. The support and seating apparatus (10) of claim 1, wherein the support and seating apparatus (10) further comprises a first stand frame (16) and a second stand frame (26), wherein the first stand frame (16) is an U-shaped bracket having a first end (16*a*) pivotably and removably connected to the first end (12*a*) of the first torso support bar (12) and a second end (16*b*) pivotably and removably connected to the first end (22*a*) of the second torso support bar (22), wherein the second stand frame (26) is an U-shaped bracket having a first end (26*a*) pivotably and removably connected to the second end (12*b*) of the first torso support bar (12) and a second end (26*b*) pivotably and removably connected to the second end (22*b*) of the second torso support bar (22); and wherein the support and seating apparatus (10) is used for land applications, the support and seating apparatus (10) is held either with the first stand frame (16) and the second stand frame (26) resting on a land surface (40) or with the first torso support bar (12) and the second torso support bar (22) resting on the land surface (40) directly.

3. The support and seating apparatus (10) of claim 1, wherein the support and seating apparatus (10) is foldable to a flat configuration such that the first back support bar (11), the first torso support bar (12), the first leg support bar (13), the second back support bar (21), the second torso support bar (22), the second leg support bar (23), the first arm support bar (18), the second arm support bar (28), the first connection bar (19) and the second connection bar (29) are all generally in one plane.

4. The support and seating apparatus (10) of claim 1, wherein a first foot pedal (42) and a second foot pedal (43) are attached on the foot pedal shaft (30) for manual driving of the first propeller (17) and second propeller (27).

5. The support and seating apparatus (10) of claim 1, wherein the support and seating apparatus (10) further comprises an entertainment panel (32) removably disposed on the first arm support bar (18) or the second arm support bar (28), wherein the entertainment panel (32) comprises a water-proof speaker (38), and a cup holder (36).

6. The support and seating apparatus (10) of claim 5, wherein the water-proof speaker (34) is a Bluetooth speaker with internal battery power.

7. The support and seating apparatus (10) of claim 5, wherein the entertainment panel (32) is floatable.

8. The support and seating apparatus (10) of claim 1, wherein the support and seating apparatus (10) further comprises a head support roll (31) disposed between the first end (11*a*) of the first back support bar (11) and the first end (21*a*) of the second back support bar (21), wherein the head support roll (31) is floatable.

9. The support and seating apparatus (10) of claim 1, wherein the support and seating apparatus (10) further comprises an adjustable shade apparatus (70) having a first connection bracket (71), a second connection bracket (72) and a cover (73), wherein the first connection bracket (71) is removably and pivotably attached to the first end (11*a*) of the first back support bar (11), wherein the second connection bracket (72) is removably and pivotably attached to the first end (21*a*) of the second back support bar (21), wherein the cover (73) is pivotably connected to the first connection bracket (71) and the second connection bracket (72), wherein the shade apparatus (70) is pivotable between a deployed position and a folded position, wherein at the deployed position, the shade apparatus (70) provides a desired shade means to block unwanted sunlight; wherein at the folded position, the shade apparatus (70) retracts to be generally aligned with the first and second back support bars on a side opposite to the direction of the first and second arm support bars.

10. The support and seating apparatus (10) of claim 9, wherein the cover (73) is made of light reflective material.

11. The support and seating apparatus (10) of claim 9, wherein a solar panel (74) is disposed on at least part of the cover (73).

12. The support and seating apparatus (10) of claim 1, wherein the long floatable cylinders (34) have cross section of a circle, oval, rectangle or square.

13. The support and seating apparatus (10) of claim 1, wherein the long floatable cylinders (34) are made of light weight material.

* * * * *